United States Patent [19]

Guezou et al.

[11] Patent Number: 4,862,820

[45] Date of Patent: Sep. 5, 1989

[54] PROPULSION AND LIFT SYSTEM FOR SPEED BOATS WITH SUBMERGED FOIL

[75] Inventors: Jean-Pierre R. Guezou, Athis -Mons; Bertrand Lambati; Robert Balquet, both of Paris; Michel Machabert, Meurthe-et-Mosselle, all of France

[73] Assignee: Etat Francais, Paris, France

[21] Appl. No.: 102,673

[22] Filed: Nov. 19, 1987

[30] Foreign Application Priority Data

Oct. 17, 1986 [FR] France ..... 86 14436

[51] Int. Cl.[4] ..... B63B 1/24

[52] U.S. Cl. ..... 114/278; 440/38

[58] Field of Search ..... 114/272, 274, 275, 278, 114/281, 282, 284, 289; 440/38

[56] References Cited

U.S. PATENT DOCUMENTS 3,044,432 7/1962 Wennagel et al. ..... 114/280

3,171,379 3/1965 Schell, Jr. et al. ..... 114/278

3,977,348 8/1976 Bordat et al. ..... 114/280

4,335,671 6/1982 Warner et al. ..... 114/278

*Primary Examiner*—Joseph F. Peters, Jr.

*Assistant Examiner*—Jesus D. Sotelo

*Attorney, Agent, or Firm*—Oliff & Berridge

[57] ABSTRACT

The invention relates to a propulsion and lift system for speed boats with a submerged foil. According to the invention, foil (4) includes main lifting surface (11) and hinged trailing edge aileron (12) as well as components (14, 25; 15, 16) to inject gas at high velocity from the lower surface of the main lifting surface and the upper surface of the trailing edge aileron. This provides lift at low speed, in particular lift augmenting at takeoff and defines a nozzle (13) with a two-phase flow which alone provides propulsion at high speed by expansion of a gas-liquid emulsion in said nozzle. Application is to the design of fast hydrofoils.

18 Claims, 5 Drawing Sheets

PROPULSION AND LIFT SYSTEM FOR SPEED BOATS WITH SUBMERGED FOIL

Figure 1:
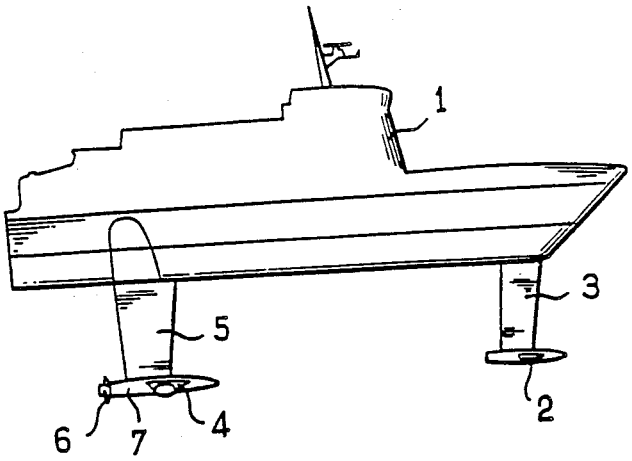

The invention concerns a propulsion and lift system for fast ships with submerged lifting surface, in particular hydrofoil type ships.

Hydrofoils with fixed V-shaped self-stabilizing lifting foils have been designed. Such hydrofoils represent the first generation, with very limited performance in speed (approximately 35 knots) due to their sensitivity to the state of the sea.

This is why second-generation hydrofoils were designed with submerged lifting surfaces connected to the hull by one or more pylons. These hydrofoils use conventional propulsion by propellers or by hydrojet. Although the speed performance is better than with the first generation hydrofoils, it is still limited. In effect, the phenomenon of cavitation requires limiting the speed to 40 knots with a conventional propeller, or to 50 knots by using a supercavitating propeller, which requires very high power. This speed can also be achieved with hydrojet propulsion, which however also requires high power to operate the accelerating pumps; this leads to increasing the height of the pylons, the weight of the assembly and thereby the submerged area. In addition, control is mainly by angle of attack, by deflecting the lifting surfaces. Control is difficult because of sudden changes in angle causing drag and lift discontinuities which increase with the area of the lifting surfaces (as an indication, a 500 metric ton hydrofoil craft requires an area of approximately 50 square meters for the lifting surface).

This led to designing different propulsion systems for third generation vessels, using an air/water emulsion in a nozzle.

Provision was thus made for integrating a "hydroramjet" in the lifting surface of a hydrofoil, including an expansion nozzle in which an air/water emulsion is accelerated to produce the propulsion effect. Such a propulsion system is illustrated in French patent 1,469,780. The resulting ramjet uses a compressible fluid requiring expansion in a stage of the nozzle including a converging section, a throat and a diverging section. This requires a long length of nozzle, equal to that of the lifting surface which results in very high drag at high speed and poor integration of the propulsion and lift functions, since the surface is not an effective lifting surface at low speed when the ramjet is not in operation. In addition, control is very difficult in spite of the existence of the two adjustment means comprised of a hollow body mobile in translation at the nozzle throat as well as a flap hinged directly on the lifting surface at the exit of the jet: in effect, deflection of the flap modifies lift, which also requires modifying the position of the hollow body in the nozzle. In the final analysis, such hydrofoils do not allow hydrodynamic optimization of the lifting surface and prove relatively incapable of operating without gas injection.

Reference can also be made to U.S. Pat. No. 3,171,379 describing a propulsion system of the same type.

A similar technique was also used for surface-effect ships as is illustrated in U.S. Pat. No. 3,117,545. Lift of the vessel at low speed is provided only by two fixed flaps, the aft flap describing a flow nozzle with the longitudinal wall of the air cushion. In addition to mediocre lift at low speed, the overall efficiency of the nozzle is relatively poor owing to the fact that there is no difference in speed between the fluid and the jet of gas (only the gas pressure is involved), resulting in an unstable expansion and a relatively nonhomogeneous mixture: here again, the propulsion efficiency is poor and the speed performance remains very limited.

Mention can also be made of French patent 1,071,658 and British patent 388,696 to illustrate this type of technique.

Other techniques were proposed to improve the propulsion efficiency. On this subject can be mentioned French patent 72 32191 and its Addition Certificate 72 08233. The system illustrated therein includes a gas generator axially creating a homogenous layer of gas under the hull of the ship and a notched laminar profile to disturb the axial flow of the layer of gas, thereby generating an axial effect and a transverse emulsion effect; in particular, vertical structural elements can be used in pairs to generate a transverse emulsion effect. The technique is actually essentially a lubrication technique which improves the propulsion efficiency but substantially increases the drag because of the elements dividing the sheet of air.

Finally, a very interesting propulsion system has been proposed, as illustrated in French patent 2,261,926.

This system is a gas jet propulsion system called "staggered dilution emulsifier" or EDE, in which a gas jet is injected into a simply converging nozzle with a very low angle of incidence and a very high speed. The emulsion is expanded in a nonconverging stage. Two flaps hinged on the injection stage are used to vary the inlet cross section of the diffuser and the outlet cross section of the expansion stage, thereby increasing or decreasing the thrust respectively when these cross sections are decreased. Unlike the previous techniques, the velocity of the gas is much higher than that of the water, which causes a large shear effect during injection.

Such a propulsion system theoretically allows speed ranges considerably exceeding 50 knots. However, it must be integrated in the ship which is difficult, since a conventional installation in a pod would be incompatible with the characteristics sought.

The invention is aimed at providing an integrated system combining propulsion and lift at all speeds with a high propulsion efficiency giving access to high speeds, in particular above 60 knots for ships from 200 to 500 metric tons.

Another aim of the invention is to provide a system allowing optimum use of a conventional propulsion system at low speed and a gas jet propulsion system by staggered dilution emulsifier at high speed, the second propulsion system being of the type described in French patent 2,261,926.

Another aim of the invention is to provide a propulsion and lift system facilitating control over the entire range of speeds considered.

It is more particularly a propulsion and lift system for speed boats with submerged lifting surface, such as hydrofoil craft, characterized by the fact that the lifting surface includes a main lifting surface and a hinged trailing edge aileron as well as means for injecting gas at high speed and low incidence from the lower surface of the main lifting surface and the upper surface of the trailing edge aileron and by the fact that the main lifting surface and trailing edge aileron provide lift at low speed in the absence of gas injection, with propulsion ensured conventionally by mechanical means and defining a two-phase flow nozzle in a biplane position providing propulsion at high speed in case of injection of gas in the overlapping area by expansion, in a nonconverging stage of said nozzle, of the gas-liquid emulsion which is generated therein, at which time the propulsion functions are integrated with the lift functions of the lifting foil.

Preferably, the trailing edge aileron is capable of being integrated in the main lifting surface to form a single foil with flat profile delaying the occurrence of cavitation as long as possible; in particular, the trailing edge aileron can be extended and deflected with respect to the main lifting surface to provide additional lift at takeoff.

Possible deflection of the trailing edge aileron is preferably provided from the integrated position of said aileron and the main lifting surface with respect to the pylon(s) connecting it to the ship's hull, deflection of one and/or both allowing control in subcavitating flight; actually, deflection of only the trailing edge aileron is preferable, because of problems of cavitation, during the subcavitating phase of flight after takeoff.

According to one of the advantageous characteristics of the invention, the biplane assembly formed by the main lifting surface and the trailing edge aileron during propulsion at high speed defines an interplane which is designed to be adjustable to adapt the expansion stage to the conditions of flight; this adjustment is particularly advantageous in the transient phase during which propulsion by gas jet begins to be the only mode used.

Preferably, the gas injection means include a feed line for the main lifting surface and the trailing edge aileron, located along the span of the lifting surface and conveying the gas through an associated channel to at least one injection slot; as a variant, the main lifting surface includes at least two parallel injection slots, each of said injection slots being connected to the feed line by a separate channel such that the gas is injected through one or the other of the slots.

In any case, it is advantageous to provide means allowing adjustment of the characteristics of the gas fed through the associated injection slots. In particular, the injection means can include a spool rotating in a cylinder with ports, interposed between the feedline and the associated channel(s), the rotation of said spool being used to adjust the pressure of the gas injected through the associated injection slot; it may prove advantageous to provide guide panels on the feed line of the main foil to direct the gas streams to predetermined inlet ports of the cylinder to improve distribution of the gas pressure along the span. The gas injection means associated with the main lifting surface and the trailing edge aileron are preferably coupled to allow distribution of the gas pressure to be adjusted in the biplane assembly.

According to an advantageous characteristic, when the high speed propulsion state is established, the trailing edge aileron is maintained in its adapted position and stabilization and control are then achieved by choosing the gas flow and/or the distribution of the gas injected in the biplane assembly, with the advantage of a very fast response time, which allows accurate control without requiring action on protruding moving parts.

According to another advantageous characteristic, the system of the invention includes means allowing gradual power transfer from conventional propulsion to the propulsion by expansion of the gas-liquid emulsion in the nozzle; in particular, the gradual transfer means can include a reduction bevel gear system whose outlets actuate a conventional propulsion system such as a propeller or hydrojet and/or a compressor provided for gas injection.

Various submerged foil configurations can be used in the framework of the invention. They can consist of two independent inverted-T subassemblies located transversely with respect to the hull or a single inverted $\pi$ system with a center foil connecting two pods. In the second case, provision can naturally be made for extending the center foil beyond each pod by an end foil.

Figure 2:
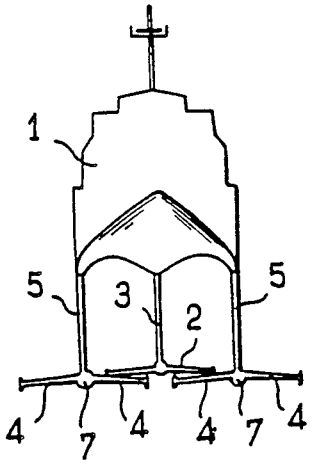
Figure 3A:
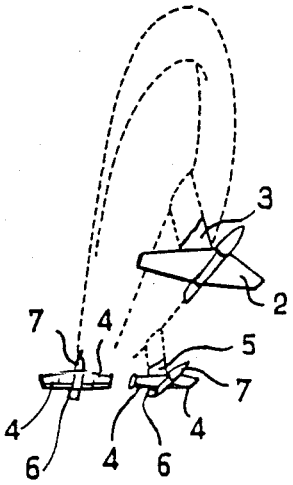
Figure 3B:
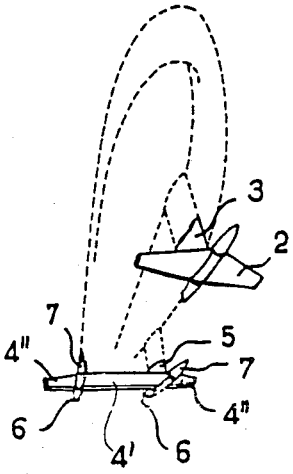
Figure 3C:
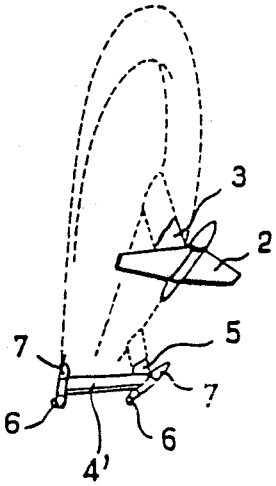
Figure 4:
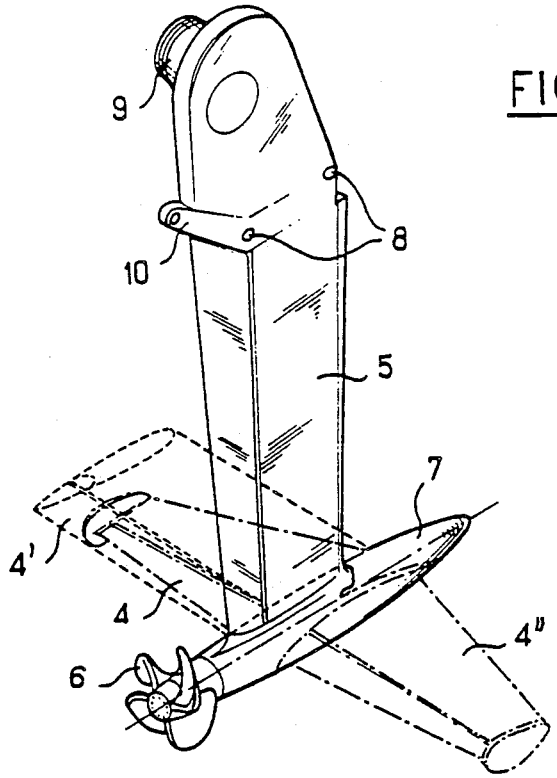
Figure 5:
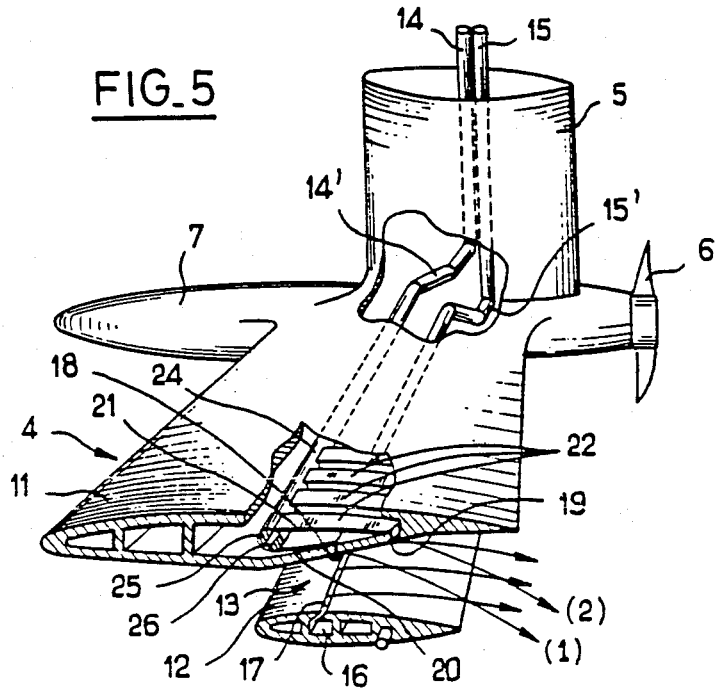
Figure 6:
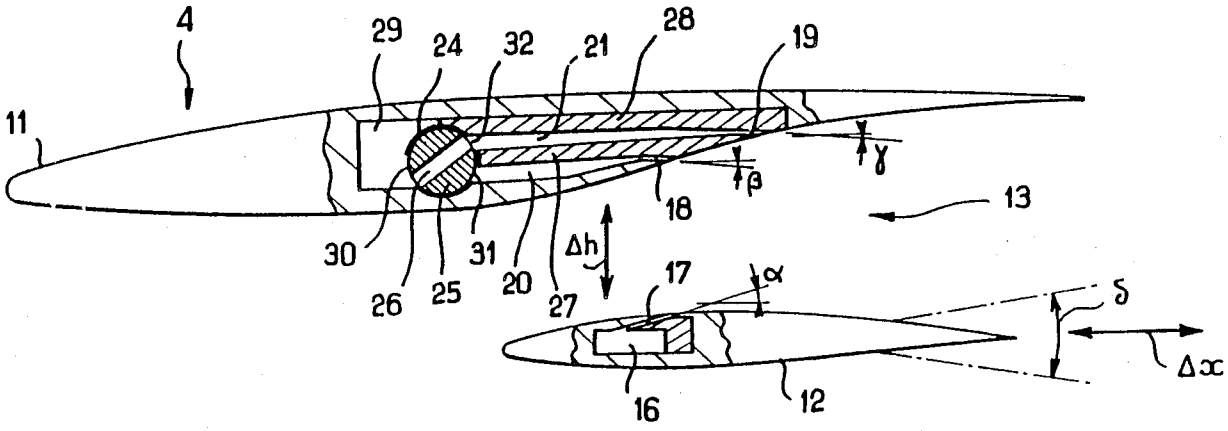
Figure 7A:
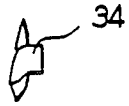
Figure 7B:
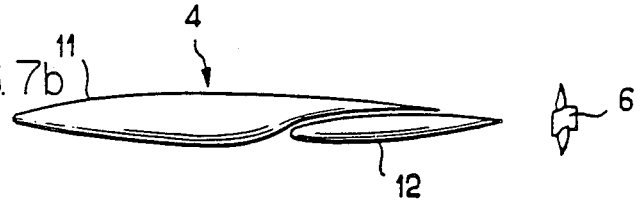
Figure 7C:
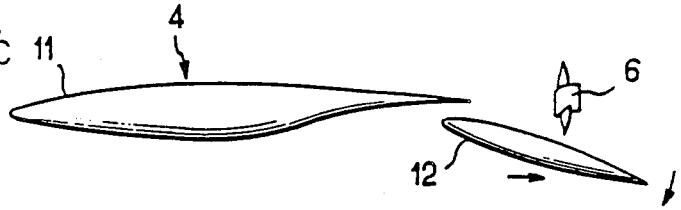
Figure 7D:
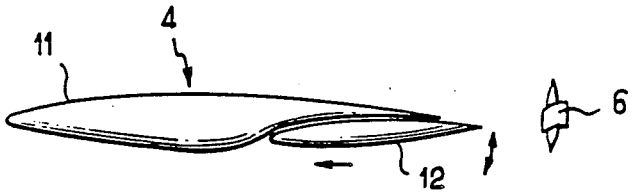
Figure 7E:
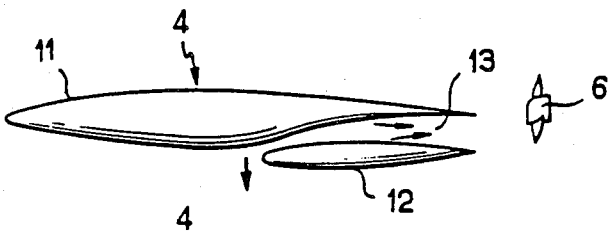
Figure 7F:
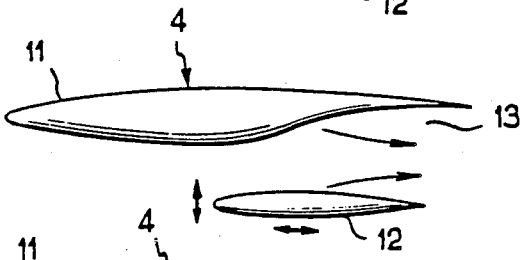
Figure 7G:
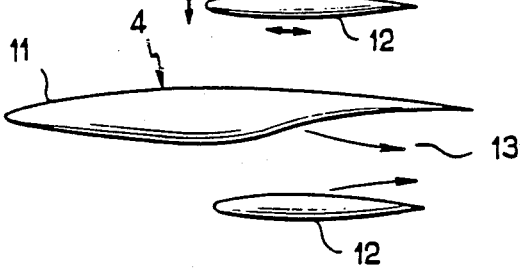
Figure 8:
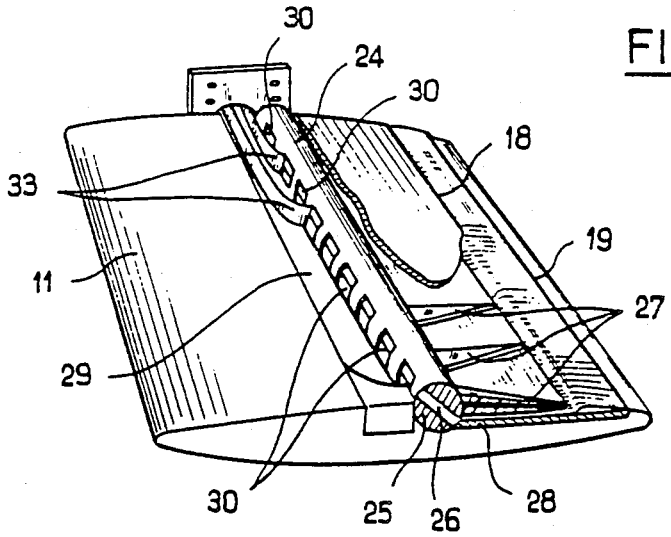
Figure 9:
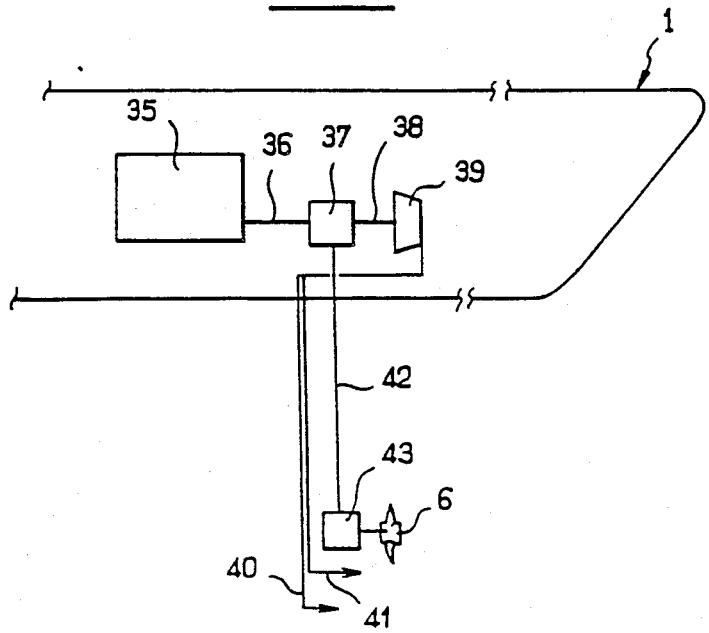

Other characteristics and advantages of this invention will appear more clearly in the following description and attached drawings concerning particular embodiments, with reference to the figures where:

FIGS. 1 and 2 are schematic elevation and end views of a speed boat of the hydrofoil type equipped aft with two foils designed according to the invention in view of integration of the propulsion and lift functions, allowing high speeds to be reached, in particular exceeding 60 knots for such a ship whose weight can be up to 500 metric tons, FIGS. 3*a* to 3*c* show the bottom view of three examples of configuration of submerged foil, here aft on the hull, FIG. 3*a* corresponding to the configuration illustrated in FIGS. 1 and 2, FIG. 4 is a perspective view of an aft pylon at the end of which is mounted a pod with propeller and a submerged foil for which the three above configurations are illustrated by dotted and dotted/dashed lines, FIG. 5 is a perspective view, partially exploded, of an integrated propulsion and lift system showing the injection means provided for the biplane assembly formed by the main lifting surface and the trailing edge aileron in high-speed position, FIG. 6 is a cross section of the biplane assembly of FIG. 5, schematically illustrating the various adjustment parameters provided in the framework of the invention, FIG. 7 schematically illustrates the various phases of flight of a hydrofoil craft equipped with a propulsion and lift system according to the invention, reflecting the gradual use of the various propulsion systems from harbor maneuvers by hull propeller (diagram a) to stabilized flight at high speed under the sole effect of expansion of a gas-liquid emulsion (diagram g), FIG. 8 is a perspective view of a foil, partially exploded to show a particular structure of the injection means provided for the main lifting surface, FIG. 9 is a schematic view illustrating a possible configuration of power transfer means, allowing gradual transition from conventional propulsion by propeller to propulsion by expansion of gas-liquid emulsion.

FIGS. 1 and 2, a high-speed craft 1 of the hydrofoil type, is equipped forward with lifting surface 2 mounted at the end of pylon 3 and aft with a foil consisting of two identical subassemblies 4 at the end of an associated pylon 5 in an inverted T arrangement. Each subassembly includes a conventional propulsion system, in this case a high performance marine propeller 6 and a propulsion and lift system forming the main subject of the invention which is described below in detail.

This configuration is illustrated in an underwater view in FIG. 3*a*. It is naturally possible to use a single inverted $\pi$ system with a center foil 4' connecting the two aft pods 7, with or without end foils 4'' as illustrated in FIGS. 3*b* and 3*c* respectively. The arrangement of the above lift systems could also be inverted, with the foil located in this case forward on the ship and the lifting surface aft.

FIG. 4 illustrates support pylon 5 of conventional design with two links 8 for attachment to the hull of the ship and pivot 9 connected to the hull to raise the lift system after unlocking links 8 by action of linkage (not shown) hinged at the end of raising lever 10.

The three configurations of the submerged foil shown in FIGS. 3*a*, 3*b*, 3*c* are represented by dotted/dashed and dotted lines. For clarity of description, below reference will be made only to a submerged foil 4, it being understood that it can be a double independent foil 4 in two parts on either side of the associated pod 7 (dotted-dashed lines) or a center foil 4′ connecting two pods 7 (dotted lines) which may be extended by two end foils 4″ beyond pods 7 (dotted lines and dotted-dashed lines). The submerged foil may naturally be set at an angle by conventional means not shown.

According to an essential feature of the invention, and as illustrated in FIGS. 5 and 6, foil 4 includes a main lifting surface 11 and a hinged trailing edge aileron 12, as well as means for injecting gas at high speed and at a low incidence from the lower surface of the main lifting surface 11 and the upper surface of the trailing edge aileron 12. Thus, according to a fundamental principle of the invention, the main lifting surface 11 and the trailing edge aileron 12:

provide lift at low speed in the absence of gas injection, at which time propulsion is provided conventionally by mechanical means (in this case a marine propeller 6, which could be replaced by hydrojet propulsion), and define a two-phase flow nozzle 13 in a biplane position providing propulsion at high speed, in case of gas injection into the overlapping area by expansion effect in a nonconverging stage of said nozzle 13 of the gas-liquid emulsion which is generated.

This achieves integration of the propulsion functions with the lift functions of foil 4.

The link between the trailing edge aileron 12 and the main lifting surface 11 is not shown to simplify the drawing; conventional linkage of the type used on large cargo aircraft will be used to control the trailing edge flaps. This linkage should in effect allow three degrees of freedom, as is shown in FIG. 6: an offset $\Delta x$, an interplane $\Delta h$ and a deflection angle $\delta$.

The trailing edge aileron is thus connected to a conventional deflection plate whose movement is controlled by devices such as actuators housed in the pylon of the foil.

It should be noted that the flaps hinged on a lifting surface provided on certain existing lift systems generally only have one degree of freedom, i.e. the deflection angle.

The offset $\Delta x$ and the interplane $\Delta h$ provided in this case allow all the intermediate configurations to be obtained, in particular a retracted position defining a single foil with a flat profile (the trailing edge aileron can be integrated in the main lifting surface) and a biplane position to define a geometry whose configuration can be selected; foil 4 is represented in such a biplane position in FIGS. 5 and 6.

The various relative positions between the main lifting surface 11 and the trailing edge aileron 12, corresponding to phases of flight associated with the entire range of speeds provided, will be described in greater detail below considering diagrams (a) to (g) of FIG. 7.

An embodiment of the gas injection means will now be described, it being understood that the structure of these means may be modified according to the type of speed boat equipped with the propulsion and lift system of the invention. However, whatever the structure retained, a basic principle in the framework of this invention must be preserved, according to which the foil first fulfills a lift function when propulsion is provided by conventional means, i.e. when the gas injection means are not used for propulsion, then an additional propulsion function when said injection means are used.

The system of the invention thereby radically differs from the systems mentioned above, since the integration achieved allows control of the speed boat thus equipped over the full range of speeds; by contrast, the known third-generation hydrofoils using the propulsion effect of expansion of a gas-liquid emulsion in a nozzle, do not have this integration and have propulsion surfaces which provide very little lift at low speed. This naturally has a direct, very large influence on stabilization and controllability.

FIG. 5 shows two supply lines, 14, 15, associated with main lifting surface 11 and trailing edge aileron 12 respectively. These lines are mounted downstream of a compressor (not shown) and arrive by pylon 5 of foil 4. The connection with change of direction is made on pod 7 by associated sections 14′, 15′ forming jointed bends, rigid or flexible, equipped with conventional swivel clamps. An installation on panels whose motion is servoed to that of the foil (main lifting surface and/or trailing edge aileron) could advantageously be provided so as not to apply excessive loads to the vulnerable parts of these lines.

For trailing edge aileron 12, line 15, 15′ is connected to a longitudinal channel 16 communicating with a slot 17, continuous in this embodiment, open on the upper surface. This slot is inclined aft at a low angle $\alpha$ (FIG. 6) which is, for instance, in the neighborhood of 10 degrees. In this way is obtained an injection distributed uniformly along the span of the trailing edge aileron.

For main lifting surface 11, means identical to the above can be used. It is however more advantageous to provide a structure allowing adjustment of the injection condition on the lower surface of the main lifting surface.

Two parallel slots 18, 19 are provided: the optional duplication of the slots allows the length of the expansion stage to be modified. These slots are open on the lower surface of the main lifting surface 11 in the area where it overlaps with trailing edge aileron 12. So as to be able to use one or the other of the slots, each is connected to the supply line by an independent channel, 20, 21 respectively. These channels can be defined as tubular sections 22 (FIG. 5) mounted on a cylindrical supply duct 24 (made of brass for instance) in which is mounted spool 25 whose axial transverse opening 26 supplies one or the other of the slots (streams 1 or streams 2) according to the angular position of said spool. As an alternate, channels 20, 21 can be defined as a series of spacers 27, 28 (FIG. 6). These spacers can be parallel, in which case each of injection slots 18, 19 is defined as a series of small slots. These spacers can also be inclined to form channels tapering out aft toward the trailing edge aileron, the adjacent outlet slots thus defined opening into a common slot which is continuous in this case. These provisions are aimed at eliminating the drawback of pressure losses and thereby substantially improving the flow characteristics of the injected gas. Such channels with a trapezoidal shape are illustrated on the bottom view of FIG. 8.

In FIG. 6 is illustrated a continuous supply chamber 29 (directly supplied by line 14, 14'). Duct 24 then has a large number of inlets 30 whose size allows the supply of channels 20, 21 by corresponding outlets 31, 32 respectively.

Rotation of spool 25 therefore is used not only to change from one injection slot to another but also to adjust the pressure of the gas exiting from said injection slot which provides an additional, easily controllable adjustment parameter. Coupling of the injection means associated with the main lifting surface and the trailing edge aileron could also be provided to allow the gas distribution in the biplane assembly to be adjusted, giving another gas injection adjustment parameter. It may prove useful, in the case of large hydrofoils, to improve the distribution of the gas supply flow rate along the span of the main lifting surface. This may be achieved by providing guide panels 33 channeling the gas streams to predetermined inlets 30 in duct 24 as shown in FIG. 8. By supplying a larger number of openings 30 in the tip of the foil than in the root, the real load of the main lifting surface according to the span is taken into account better making it possible to achieve a higher overall pressure.

This makes it possible to inject gas at very high velocity and at a small angle (outlet angles and of injection slots 18; 19 — see FIG. 6 — are approximately 5 degrees) in the expansion stage of nozzle 13 defined by main lifting surface 11 and trailing edge aileron 12, when these lifting elements are in a biplane position, the propulsion effect being obtained by expansion of the gas/liquid emulsion in a nonconverging stage of the nozzle, according to the principle of propulsion by staggered dilution emulsifier (EDE) described in French patent 2,261,926. The injection produced in the area where the two lifting elements overlap thus provides the very efficient short expansion effect produced with a propulsion system of the type of the above-mentioned patent. Owing to the short length of expansion required by this type of propulsion, it can be arranged at the aft end of the submerged foil which, combined with the lift effect provided by the structure of the main lifting surface and the trailing edge aileron, makes it possible to achieve very high performance by combining propulsion and lift at all speeds.

The various phases schematically illustrated in FIG. 7 clearly show the advantages of the system of the invention, with the adaptability of the foil to the flight condition to allow increasingly accurate control as the ship reaches high speeds.

(a) The foil is raised and an auxiliary propulsion system on the hull is used for harbor maneuvers; this propulsion system is schematically illustrated here by hull propeller 34.

(b) Foil 4 is submerged and a main propulsion system, in this case marine propeller 6, replaces the auxiliary propulsion system; the configuration illustrated corresponds to navigation at low speed for exit from the harbor (speeds of approximately 10 to 15 knots), with trailing edge aileron then integrated in main lifting surface 11.

(c) Trailing edge aileron 12 is extended and fully deflected (angle $\delta$ is approximately 12 degrees), such that the submerged foil 4 provides a lift augmenting function during takeoff, allowing as low as possible a takeoff speed, of 20 to 25 knots; the main propulsion system is then operating at maximum power and maximum propulsion efficiency.

(d) Trailing edge aileron is retracted toward main lifting surface 11 to achieve a flat profile and the ship is in the subcavitating phase of flight. A speed of 50 knots can then be achieved without cavitation by high performance marine propeller 6. Control is preferably achieved by acting only on the trailing edge aileron (without modifying the setting of the main lifting surface) to avoid problems of cavitation, essentially by adjusting deflection angle $\delta$ and possibly offset $\Delta x$ to facilitate control in the event of swell (in effect, the slot thus generated modifies the angle of attack of the lifting surface by the fluid).

(e) Trailing edge aileron 11 is lowered to increase interplane $\Delta h$ and define an expansion stage, and the gas injection means are actuated: this is a transition phase during which the power is gradually transferred from the conventional propulsion system (propeller 6) to the staggered dilution emulsion (EDE) propulsion system in nozzle 13 with nonconverging expansion stage thus defined; an example of means allowing such a power transfer is illustrated in FIG. 9 and described below.

(f) Power transfer is completed and propulsion is provided by the EDE system alone. This phase corresponds to adaptation of the biplane assembly to the speed concerned (speeds of approximately 50 to 60 knots), by varying the adjustment parameters of the trailing edge aileron ($\Delta h$, $\Delta x$, $\delta$); for optimum configuration of the expansion stage to the EDE system (in particular, to approach a value of 1.2 for the ratio of the outlet to the inlet sections of the diffuser and a value of 6 for the ratio between the length of the expansion stage and the height of the outlet fluid stream).

(g) The speed is established and main lifting surface 11 and trailing edge aileron 12 are maintained in their adapted relative position, reached at the end of previous phase, the speed then largely exceeding 60 knots. Stabilization and control of the ship are then achieved by varying the flow rate of injected gas and the distribution of gas between the main lifting surface and the trailing edge aileron (experience shows that complete suppression of injection by the trailing edge aileron causes a large reduction in performance and an unstable hydrodynamic flow different from the EDE type flow, such that in practice, a distribution above 90 percent for the main lifting surface and 10 percent for the trailing edge aileron should not be exceeded).

From the above explanations, it can be seen that control becomes more accurate as the speed of flight increases: when the EDE propulsion phase has stabilized, the thrust and lift are controlled by the gas, which allows accurate control since the configuration of the submerged foil is not modified, such that no protruding mechanical parts need to be adjusted. This illustrates well that the integrated propulsion and lift concept of the invention radically differs from the systems used until now for the "hydrojet" third-generation hydrofoils.

Thus, in the framework of this invention, the trailing edge aileron can ensure, with the integrated propulsion and lift concept, different functions during the different phases of flight lift augmenting during takeoff control during subcavitating flight contribution to integration of propulsion and lift with adaptation of the EDE expansion stage to the conditions of flight participation during steady state (EDE propulsion alone) in stabilization and control of the vessel by gas injection since the trailing edge aileron remains essentially fixed during this phase of flight.

FIG. 9 illustrates a possible embodiment of the means allowing gradual power transfer from conventional propulsion to EDE propulsion, embodiment in which these means are mainly mechanical.

Engine 35 of the ship is connected by outlet shaft 36 to the inlet of reduction bevel gear 37: a first outlet shaft 38 acts on compressor 39 whose outlet lines 40, 41 are connected to the air supply lines 14, 15 of the main lifting surface and the trailing edge aileron, with a second outlet shaft 42 connected to bevel gear 43 of propeller 6.

Such an embodiment allows the desired power transfer to be easily achieved. Naturally, another embodiment with a compressor directly coupled to the engine could be provided, with said engine then having two independent outlets; this solution, probably simpler as regards the transmission mode, would however have the drawback of requiring a control law specific to the compressor.

It has been shown that the system of the invention thus effectively combines propulsion and lift. Moreover, with integration of the system, combined with an additional pneumatic type power transmission, the requirement for additional large pods for transmission of the propulsion power is made unnecessary. It is moreover this sensitivity to drag which establishes the practical limit of the system to medium tonnage speed boats (the actual limit could be estimated at approximately 500 metric tons); in any case, the higher the tonnage of the ship, the greater the tendency to use the full available width for the submerged foil.

The system of the invention thus allows a constant lift to be maintained, avoiding the deceleration effects caused by waves; accurate control at high speed is facilitated, since, if the air flow increases, the lift also increases thereby counteracting the deceleration effect, which substantially improves the stability of the ship as regards position and speed.

The invention is not limited to the embodiment described above, but on the contrary covers all the alternates using the essential means described in the claims in an equivalent manner.

In particular, additional means could be provided to adjust the cross-sectional area for the gas on the injection slots.

Similarly, the type of application described above for the system should not be considered restricted: for instance, a "submerged foil" with an essentially stabilizing function is conceivable.

We claim:

1. Propulsion and lift system having propulsion and lift functions for speed boats having a submerged foil, wherein said foil includes a main lifting surface and hinged trailing edge aileron as well as means to inject gas at high velocity and at a low angle relative to and from the lower surface of said main lifting surface and relative to and from the upper surface of said trailing edge aileron whereby the main lifting surface and trailing edge aileron both provide lift at low speed in the absence of gas injection, at which time propulsion is provided conventionally by mechanical means, and define a nozzle with a two-phase flow and defining a biplane assembly providing propulsion at high speed, by injection of gas in the space between said main lifting surface and said aileron, in a nonconverging stage of said nozzle, by the expansion effect of an emulsion generated by gas and liquid, at which time the propulsion functions are integrated with the lift functions of the foil.

2. Propulsion and lift system according to claim 1, characterized in that said trailing edge aileron can be integrated with said main lifting surface to form a continuous foil with a substantially flat profile, delaying the occurrence of cavitation.

3. Propulsion and lift system according to claim 2, characterized in that said trailing edge aileron can be extended and deflected with respect to the main lifting surface to ensure a lift augmenting function during takeoff.

4. Propulsion and lift system according to claim 3, wherein deflection of said trailing edge aileron is defined from the integrated position of said aileron and the main lifting surface with respect to a pylon connecting the foil to the hull of the ship, deflection of the position of the aileron allowing control during subcavitating flight.

5. Propulsion and lift system according to claim 1, characterized in that the biplane assembly formed by the main lifting surface and trailing edge aileron during propulsion at high speed defines an interplane which is adjustable so as to adapt the nozzle expansion stage to the flight conditions.

6. Propulsion and lift system according to claim 1, characterized in that the gas injection means include, for the main lifting surface and the trailing edge aileron, a supply line arranged along the span of the foil and directing the gas to at least one injection slot through an associated channel.

7. Propulsion and lift system according to claim 6, characterized in that the main lifting surface includes at least two parallel injection slots, each of said injection slots being connected to the supply line by an independent channel, such that the gas is injected by one or the other of the slots.

8. Propulsion and lift system according to claim 7, including means to adjust the characteristics of the gas exiting from the associated injection slot.

9. Propulsion and lift system according to claim 8, characterized in that the injection means includes a spool rotating in a cylinder with ports, interposed between the supply line and the associated channel or channels, said channel or channels being terminated by the injection slot, rotation of said spool allowing the gas pressure exiting from the associated injection slot to be adjusted.

10. Propulsion and lift system according to claim 9, characterized in that the supply line of the main lifting surface includes guide panels channeling the gas to predetermined ports in said cylinder to achieve better distribution of the gas pressure along the span.

11. Propulsion and lift system according to claim 10, characterized in that the gas injection means associated with the main lifting surface and trailing edge aileron are coupled to allow the gas distribution to be adjusted in the biplane assembly.

12. Propulsion and lift system according to claim 11, characterized in that when the high speed propulsion state is established, the trailing edge aileron is maintained in a position spaced from said main lifting surface, stabilization and control being achieved at that time by selection of at least one of the gas flow rate and the distribution of the gas injected in the biplane assembly.

13. Propulsion and lift system according to claim 1, including means for allowing gradual power transfer from conventional propulsion to propulsion by expansion of the gas-liquid emulsion in the nozzle.

14. Propulsion and lift system according to claim 13, characterized in that the gradual transfer means includes a reduction bevel gear assembly adapted to drive a conventional propulsion device.

15. The propulsion and lift system according to claim 14, wherein said conventional propulsion device is at least one of a propeller, hydrojet and compressor for gas injection.

16. Propulsion and lift system according to claim 1, characterized in that the submerged foil includes two separate inverted-T subassemblies located transversely with respect to the hull.

17. Propulsion and lift system according to claim 1, characterized in that the submerged foil comprises a central part connected to two pods.

18. Propulsion and lift system according to claim 17, wherein said central part is extended beyond each pod by an end foil.

* * * * *